US006996948B2

(12) United States Patent
Koke et al.

(10) Patent No.: US 6,996,948 B2
(45) Date of Patent: Feb. 14, 2006

(54) APPARATUS AND METHOD FOR USE IN PACKING MEAT CUTS

(75) Inventors: John P. Koke, Duncan, SC (US); Clifford B. Steele, Auckland (NZ)

(73) Assignee: Sealed Air (NZ) Limited, Hamilton (NZ)

( * ) Notice: Subject to any disclaimer, the term of this patent is extended or adjusted under 35 U.S.C. 154(b) by 0 days.

(21) Appl. No.: 10/362,433

(22) PCT Filed: Aug. 22, 2001

(86) PCT No.: PCT/NZ01/00169

§ 371 (c)(1),
(2), (4) Date: Sep. 11, 2003

(87) PCT Pub. No.: WO02/16210

PCT Pub. Date: Feb. 28, 2002

(65) Prior Publication Data

US 2004/0028777 A1 Feb. 12, 2004

(30) Foreign Application Priority Data

Aug. 22, 2000 (NZ) ..... 506489

(51) Int. Cl.
*B65B 57/00* (2006.01)

(52) U.S. Cl. ..... 53/55; 53/459; 53/504; 53/517

(58) Field of Classification Search ..... 53/459, 53/55, 504, 517

See application file for complete search history.

(56) References Cited

U.S. PATENT DOCUMENTS

| | | | | |
|---|---|---|---|---|
| 1,561,301 A | | 11/1925 | Bausman | |
| 3,872,644 A | | 3/1975 | Giraudi et al. | 53/52 |
| 4,219,989 A | | 9/1980 | Andrews | 53/572 |
| 4,720,961 A | | 1/1988 | Jordan | |
| 4,776,146 A | * | 10/1988 | Whitehouse | 53/58 |
| 5,483,786 A | | 1/1996 | Giesbrecht et al. | 53/570 |
| 5,685,129 A | | 11/1997 | Baker | 53/469 |
| 5,782,056 A | | 7/1998 | May et al. | 53/138.4 |

(Continued)

FOREIGN PATENT DOCUMENTS

EP 0 089 212 A1 3/1983

(Continued)

OTHER PUBLICATIONS

Meat New Zealand, " Machine vision—using video imaging to identify lamb carcass cuts", R & D brief, Sep. 1999, 2 pages.

*Primary Examiner*—Scott A. Smith
*Assistant Examiner*—Brian Nash
(74) *Attorney, Agent, or Firm*—Mark B. Quatt

(57) ABSTRACT

Apparatus for use in packing meat cuts including a machine vision system arranged to scan or view individual meat cuts and acquire dimensional, volume, shape, cut type, or meat quality or grading information or other information relating to the individual meat cuts, two or more meat cut packing stations arranged to receive the acquired information relating to individual meat cuts and to dispense to an operator or automatedly apply to the meat cuts a pack matched to each individual meat cut as meat cuts arrive at the packing stations, and a diversion stage arranged to direct individual meat cuts to one or other of the packing stations based on the acquired information relating to the individual meat cuts from the machine vision system.

17 Claims, 5 Drawing Sheets

U.S. PATENT DOCUMENTS

| | | | | |
|---|---|---|---|---|
| 6,267,661 | B1 | 7/2001 | Melville | 452/157 |
| 6,349,526 | B1 * | 2/2002 | Newman | 53/446 |

FOREIGN PATENT DOCUMENTS

| | | | |
|---|---|---|---|
| EP | 0 089 212 | B1 | 10/1987 |
| EP | 0 284 140 | A1 | 9/1988 |
| GB | 2 285 126 | A | 6/1995 |
| JP | 09066906 | A | 8/1995 |
| NZ | 263260 | | 3/1994 |
| WO | WO 89/06782 | | 7/1989 |
| WO | WO 89/12397 | | 12/1989 |
| WO | WO 94/20230 | | 3/1994 |
| WO | WO 95/21375 | | 8/1995 |
| WO | WO 98/00338 | | 1/1998 |
| WO | WO 98/14370 | | 4/1998 |
| WO | WO 01/02251 | A1 | 1/2001 |

* cited by examiner

APPARATUS AND METHOD FOR USE IN PACKING MEAT CUTS

FIELD OF INVENTION

The invention relates to the packing of meat cuts and typically primal red meat cuts on a packing line in a meat processing plant.

BACKGROUND

Typically in a meat processing plant carcasses are butchered to primal meat cuts which are then individually packed in bags or boxes manually by operators from a packing line.

Various equipment for automating parts of the packing process are known.

SUMMARY OF INVENTION

The invention provides an improved or at least alternative form of apparatus and method for use in packing meat cuts.

In broad terms in one aspect the invention comprises apparatus for use in packing meat cuts, which includes:

a meat cut information acquisition stage arranged to acquire information relating to one or more characteristics of individual meat cuts passing the meat cut information stage, two or more meat cut packing stations at least one of which is arranged to provide a different size or sizes or type(s) of pack from one or more other packing station(s), and a diversion stage between the meat cut information acquisition stage and the meat cut packing stations, arranged to direct individual meat cuts to one or other of the two or more packing stations based on information relating to the individual meat cuts acquired at the meat cut acquisition stage.

Preferably one or more packing station(s) is arranged to receive information relating to individual meat cuts as they leave the meat cut information acquisition stage or move between or arrive at the packing station(s), or instructions associated with individual meat cuts from a control system, and to dispense to an operator or automatedly apply to the meat cuts a pack matched to each individual meat cut arriving at the packing station.

In one configuration one or more packing station(s) may be arranged to dispense or apply larger packs and one or more other packing station(s) may be arranged to dispense or apply smaller packs, and a control system and the diversion means may be arranged to divert larger meat cuts to one or more packing station(s) and smaller meat cuts to other packing station(s). For example one or more packing stations may be arranged to dispense or apply packs of greater width and one or more other packing station(s) may be arranged to dispense or apply packs of lesser width. In addition where the packs are plastic bags the bags may be of standard lengths or alternatively one or more packing stations may also be arranged to manufacture and dispense or apply bags in different lengths from continuous bag stock, by dispensing lengths of bag stock, and cutting and heat sealing one end of the bag stock to form the bags of tailored length, based on information relating to individual meat cuts acquired at the meat Cut information acquisition stage.

Alternatively again one or more packing stations may be arranged to dispense packing material for wrapping and sealing meat cuts, in standard lengths, or in different lengths from continuous stock by cutting the packing material to length for each meat cut based on information relating to individual meat cuts acquired at the meat cut information acquisition stage. Alternatively again one or more packing stations may be arranged to wrap and seal flat packing material around the series of meat cuts passing through the packing station and to form a heat seal between every two meat cuts and a cut to separate the packed meat cuts.

In another configuration one or more packing stations may be arranged to dispense or apply packs of one type and one or more other packing station(s) may be arranged to dispense or apply packs of another type, and a control system and the diversion means may be arranged to divert meat cuts to a packing station which dispenses a predetermined pack type. For example different packing stations may dispense or apply high oxygen barrier packs, export quality packs, high puncture resistance packs for bone-in meat cuts, packs preprinted for different cut types or meat quality or gradings, or packs which are branded or otherwise pre-prepared in accordance with end-user specifications of customers for the meat cuts. These are examples and various user selected configurations and arrangements are possible.

In one form one or more packing station(s) may be arranged to dispense to an operator a number of different sizes or types of pack at the same packing station, and in this configuration preferably a control system is arranged to cause a single pack matched to each individual meat cut to be dispensed as each meat cut arrives at the packing station.

The acquired information relating to individual meat cuts may include for each meat cut any one or more of dimensional information such as length information, width information, or length and width information, volume or shape information, meat cut type information, and meat quality or grading information, or any other information relating to the meat cuts. Information acquired at the meat cut information acquisition stage optionally may be supplemented by weight information and/or information on individual meat cuts visually assessed by an operator and manually input into the system as each meat cut passes the operator. For example in one form the acquired information for each meat cut may include dimensional information or volume or shape information, and optionally weight information, and an operator may visually assess the meat cuts as to meat cut type and meat quality or grade. A manual input means may enable manual input by the operator to a control system of meat cut type information and/or meat quality or grading information.

Printing means may be associated with one or more packing stations and arranged to print on packs dispensed for or applied to individual meat cuts, as they arrive at the packing station, information indicative of one or more of the meat cut's weight, cut type, a processing or other date, carcass identification information, or other information relating to the meat cuts.

In a preferred form the diversion stage comprises a conveyor or chute arranged to swing about an axis to deliver individual meat cuts to one of two or more downstream conveyors to two or more meat cut packing stations or directly to the two or more packing stations.

In broad terms in another aspect the invention comprises a method for use in packing meat cuts, including:

acquiring information relating to one or more characteristics of individual meat cuts at as the meat cuts are conveyed past a meat cut information acquisition stage, and at a subsequent diversion stage in a conveyor system directing each of the individual meat cuts to one of two or more alternative packing stations based on the information relating to individual meat cuts acquired at the meat cut acquisition stage.

In another aspect the invention comprises a bagging apparatus for use in placing products in bags, including a conveyor on which a product may be supported while a bag is placed over the product and either means arranged to detect when the product is in the bag and arranged to then activate the conveyor to move the product and bag from the bagging apparatus, or means which may be manually activated via the bag by an operator to activate the conveyor to move the product and bag from the bagging apparatus.

In a preferred form a physically activated microswitch or similar is arranged to be contacted by the bag once the bag has been placed over the product, either manually by an operator or by an automatic bagging machine, and which then activates the conveyor on which the product is supported to eject the bagged product from the bagging apparatus or move the bagged product onto the next processing stage. Alternatively however a non-contact arrangement for detecting when the product is within the bag may be provided, such as a light beam which is broken when the bag is over the product or a more sophisticated machine vision system or similar.

BRIEF DESCRIPTION OF THE FIGURES

The invention is further described with reference to the accompanying figures which show preferred forms of apparatus of the invention by way of example and without intending to be limiting, and wherein.

DETAILED DESCRIPTION OF PREFERRED FORMS

Figure 1:
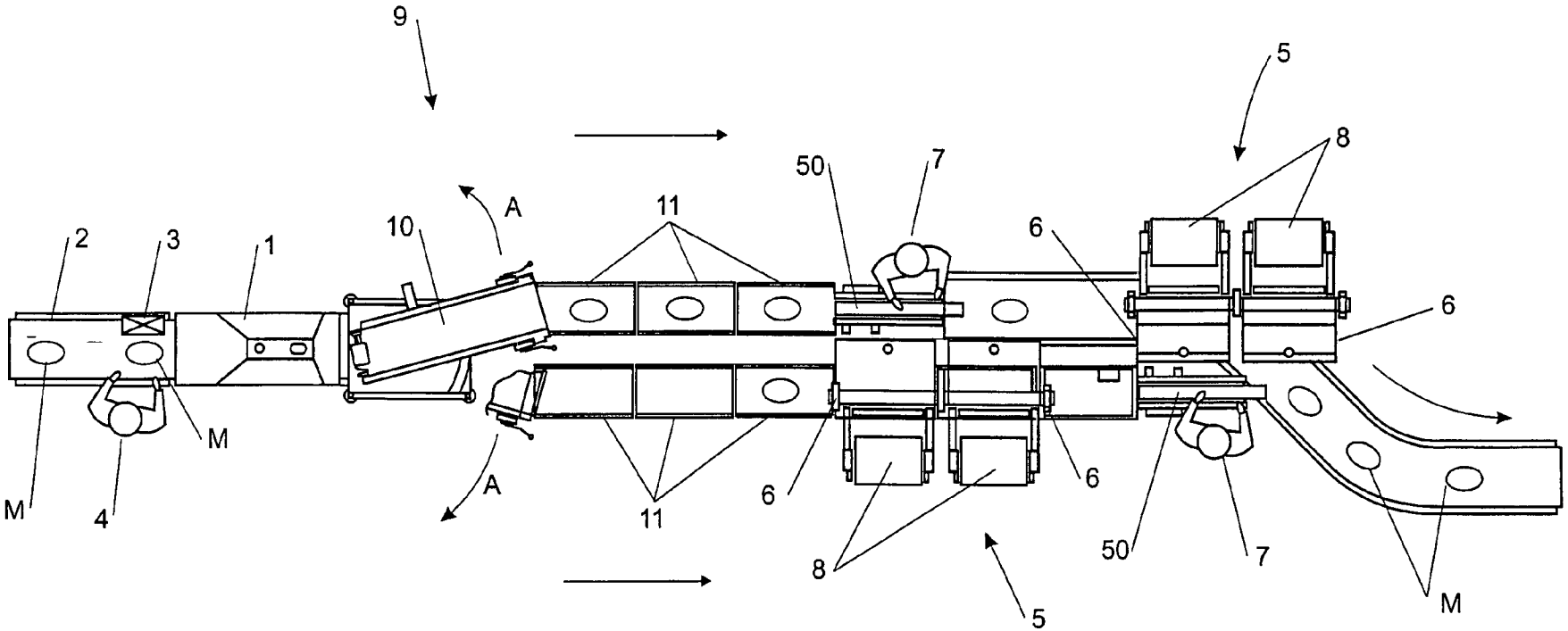
FIG. 1 is a plan view of a first preferred form of apparatus of the invention.
Figure 2:
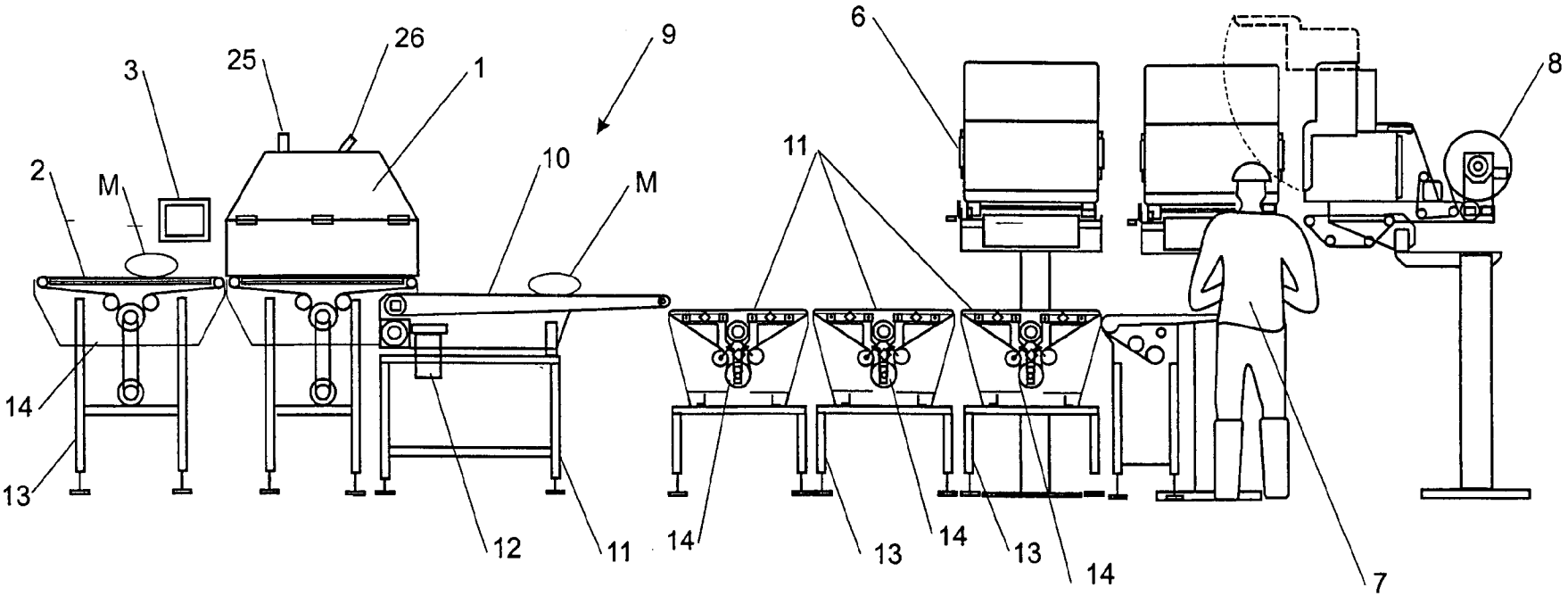
FIG. 2 is a side view of a preferred form apparatus of the invention similar but not identical to that of FIG. 1.

Referring to FIGS. 1 and 2 (noting that the side view of FIG. 2 is of preferred form apparatus similar but not identical in layout to the apparatus shown in FIG. 1), the preferred form apparatus comprises a meat cut information acquisition stage 1 which is preferably a machine vision system beneath which individual meat cuts M pass along conveyor 2. The machine vision system acquires information relating to one or more characteristics of individual meat cuts passing through the machine vision stage 1 on conveyor 2. As a minimum the machine vision system 1 may acquire simple dimensional relating to the individual meat cuts such as only one of the length or width or another single dimension of each meat cut. More preferably the machine vision system is set up to acquire further dimensional information such as the size of the meat cuts or the volume or shape of the meat cuts. Information as to the weight of each meat cut may be acquired additional to the dimensional or volume or shape information, for example by a weighing conveyor before or after the machine vision stage which weighs the individual meat cuts and passes the weight information to a control system along with the dimensional and/or volume or shape information.

The meat cut information acquisition stage may comprise a digital camera system which "sees" individual meat cuts and/or a system which directs at least one beam or line from a scanning laser over individual meat cuts on the conveyor 2. Referring to FIG. 2, in a preferred form a scanning laser 25 directs a beam over moving meat cuts passing through the machine vision stage and deflection and/or reflection of laser light on the meat cut is seen by a camera system 26, and the resulting information is processed to provide the dimensional and/or volume or shape information in relation to each meat cut. Alternatively the machine vision system may simply be a series of horizontal and vertical beams across the conveyor path at different heights or spacings through which the meat cuts pass, providing information to a control system as to the width and/or height and/or length of the meat cuts based on the number of beams broken by each passing meat cut. Any other machine vision system which enables the acquisition of information as to one or more of cut length, width, size, volume, shape or similar of the meat cuts may be used.

The acquired information may be supplied direct to individual electronic or programmed controllers for the diversion stage and the packing stations but is more preferably supplied to a common control system which controls the diversion stage, packing stations, and synchronises the arrival of individual meat cuts with the disperising or applying of individual packs to the meat cuts at each packing station.

In addition the machine vision system 1, or a separate machine vision system, may be arranged to view the meat cuts to provide information to a control system as to the meat cut type eg whether the meat cut is a boneless or bone-in cut, or as to the cut type eg rump, tenderloin etc. or other information relating to the meat cuts. Alternatively information as to the meat cut type and/or meat quality or grading information may be manually input by an operator for example via a touch screen 3 as shown in FIGS. 1 and 2, mounted adjacent the machine version stage 1. In this configuration as shown an operator such as that indicated at 4 views each meat cut M as it passes the operator towards the machine vision stage 1 on conveyor 2, and enters into the touch screen 3 for each cut as it passes, the cut type and/or meat quality or grading or other information as visually assessed by the operator.

The apparatus comprises two or more packing stations generally indicated at 5 in the drawings. In the preferred forms shown in the drawings the apparatus comprises two meat cut packing stations but a diversion stage may be arranged to divert meat cuts between three or more packing stations or between two or more packing stations and another processing stage. For example in one configuration the diversion stage may be arranged to divert individual meat cuts between an automated packing station for meat cuts within a certain standard size range or of a certain type, a manual packing station for other meat cuts, and a reject path for meat cuts which are assessed manually by an operator or by the machine vision stage as being non-standard in some respect.

In the form shown, at each of the packing stations is provided or more bag dispensers 6 which dispense plastic bags to operators such as those indicated at 7. The bag dispensers may be of known form and typically plastic bags are dispensed from rolls of bag stock 8 carried by each bag dispensers 6, or alternatively stacks of bags or any other bulk bag supply.

Alternatively one or more of the packing stations may be arranged to automatically pack meat cuts. For example an automated packing station may be arranged to dispense and insert or drop the meat cuts into plastic bags, and onforward each packed meat cut. Another form of automated packing station may be arranged to wrap a continuous section of packing material around a series of meat cuts passing through the packing station on a conveyor, and then seal the packing material around the meat cuts and cut the individual packed meat cuts from the continuous series. Again various arrangements of automated packing station may be employed.

A diversion stage 9 between the machine vision stage 1 and the meat cut packing stations 5 directs each individual meat cut M to a preselected one of the packing stations 5. In the preferred form the diversion stage comprises a belt conveyor 10 which is arranged to swing about an axis, as indicated by arrows A in FIG. 1, to direct individual meat cuts to one or other of the packing stations 5. In the preferred form the belt conveyor 10 is supported for the pivoting swing movement about a generally vertical axis by a sub-frame 11 which includes an associated pneumatic or electric drive system 12 for driving the side to side movement of the diversion conveyor 9 under control of a central control system (or alternatively the diversion conveyor may receive direction commands direct from the machine vision stage 1). The diversion stage 9 may alternatively comprise any other form of conveyor arranged to move horizontally, vertically or with any other motion between the meat cut packing stations or onward conveyors to the two or more meat cut packing stations. Alternatively the diversion stage could comprise a chute for example, down which the meat cuts move and the delivery end of which is arranged to move to deliver the individual meat cuts to the selected packing stations for each meat cut. Alternatively again the diversion stage could comprise a flipper system arranged to flip individual meat cuts from the conveyor of the diversion stage on to two or more onward conveyors taking the meat cuts to two or more different packing stations or similar. Instead of a single diverter the diversion stage could comprise two or more stages of diverters in series arranged to divert the meat cuts across a first and then second series of conveyors to packing stations and optionally other processing stages.

Different packing stations may be arranged to dispense or apply plastic packs of one or more different sizes, or different types such as packs having different oxygen barrier properties, different degrees of bone puncture resistance, packs preprinted with or different quality or grading markings or colours for different types or grades of meat cut, or packs which are branded or otherwise specified differently to meet end user specifications of customers for the meat cuts. Different packing stations may be supplied with bag or pack stock of different sizes, such as rolled tubular bag stock as indicated at 8, and the control system may be arranged to direct different meat cuts to different packing stations. Three or four or more packing stations dispensing or applying different sizes or types of packs are possible.

In one configuration different dispensers at different packing stations may be supplied with continuous tubular bag stock of different widths and bags may be manufactured to length by heat sealing and cutting lengths of the tubular stock at the time of dispensing. Bags may be pre-cut or may be manufactured at the bag dispenser(s) to a standard length for the bag stock width, or alternatively one or more of the bag dispenser(s) may receive information from a control system as to the dimensions, volume, shape, weight etc of individual meat cuts and may manufacture bags to individual lengths or to one of a range of lengths for that bag stock width, sized to each individual meat cut. Either a control system may provide to a packing station or bag dispenser controller information as the size, shape, weight or type of each individual meat cut as that meat cut is machine viewed and moves to or arrives at the packing station, or a control system may process the acquired information in relation to each cut and provide a simple command to each packing station as to the length or size or type of bag or wrap to dispense or apply to each meat cut.

In a further configuration one or more packing stations may each be arranged to deliver bags of two or more sizes or types, for example by providing two or more bag dispensers 6 at one or more packing stations. Where multiple pack dispensers are provided at a manual packing station an operator may simply manually select the desired bag or pack size or type which the operator judges most appropriate for each meat cut arriving at the packing station, but more preferably one and only one bag or pack size or type is dispensed to an operator for each meat cut, which the system selects based on the acquired information in relation to each approaching meat cut. As only a single bag or pack is automatically dispensed for each meat cut arriving at the packing station, errors in operator choice of the appropriate pack are avoided.

In the preferred form a queuing conveyor consisting of individual queue conveyor stages 11 in series is provided between the diversion stage 9 and the packing stations 5 to queue individual meat cuts while awaiting packing at a particular packing station if meat cuts are diverted to that packing station faster than an operator can pack them over any short period. Operation of the queuing conveyor stages is controlled by a central control system so that arrival of an individual meat cut at a packing station is synchronised with acquired information relating to that meat cut. In the preferred form each queuing conveyor is mounted on a sub-frame 13 and includes drive motor 14.

Figure 3:
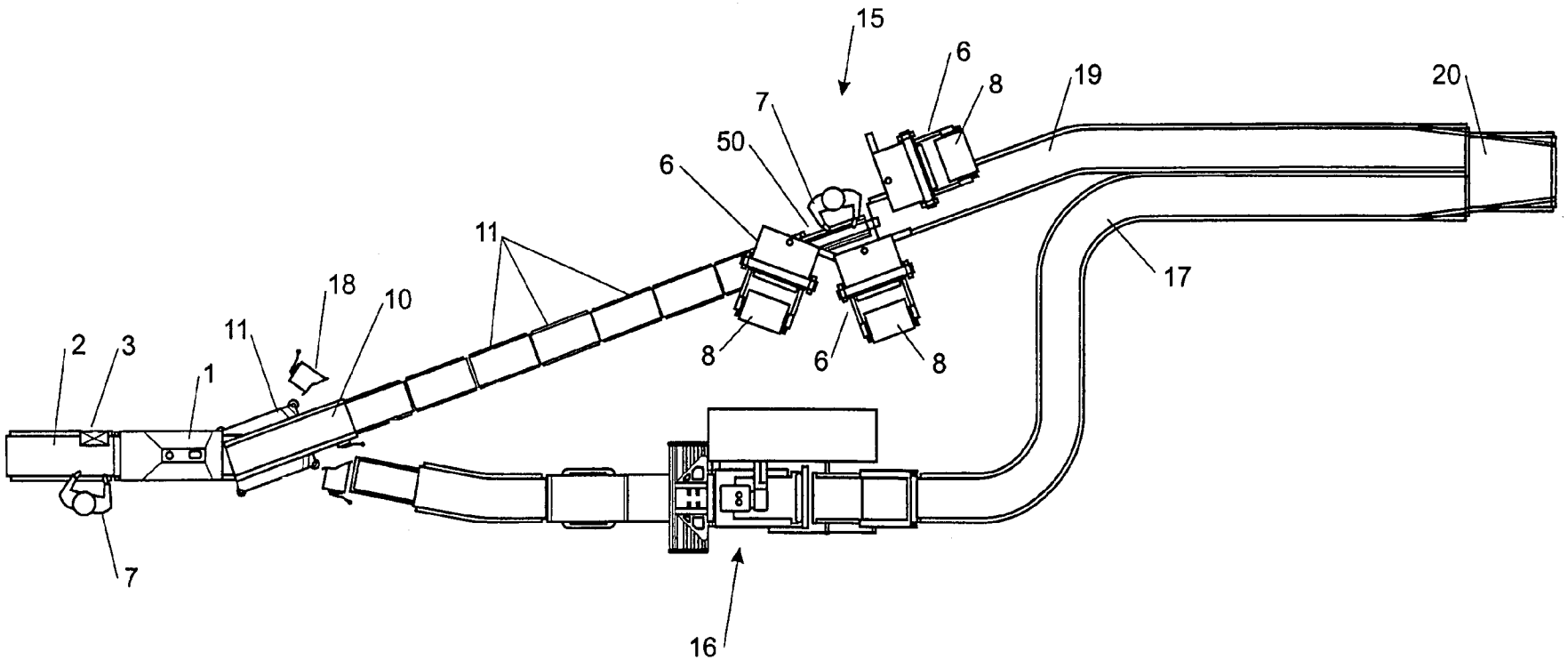
FIG. 3 is a plan view of another preferred form apparatus of the invention, FIGS. 4A to 4C schematically show the operation of a preferred form bagging apparatus of the invention.

The apparatus layouts shown in FIGS. 1 to 3 are simply examples and multiple manual and/or automated packing stations optionally combined with other processing stations may be provided in any desired configuration, such as for example a star configuration with the diversion stage at the hub or similar, or any other desired configuration for a particular meat processing plant.

To synchronise the arrival of individual meat cuts at a packing station with the acquired information relating to the individual meat cuts or pack dispense commands from a control system, a central control system may count the number of meat cuts passing the machine vision stage, store information on the packing station to which each meat cut is directed by the diversion stage, and count and store the number of packs provided at each packing station. Thus a control system may match the nth bag dispensed or applied at a packing station to the nth meat cut directed to that packing station. The system may have a "repeat facility" for manual packing stations whereby an operator may for example hit a button if a dispensed bag or wrap is damaged as it is withdrawn from the dispenser, to cause the dispenser to dispense another identical bag or wrap without affecting the pack count used to synchronise pack dispensing operations with arrival of the meat cuts at the packing station. In another arrangement acquired information relating to each meat cut may be sent directly from the machine vision stage to the packing station or bag dispensing controller at the packing station to which the meat cut is directed, and is retained in a database at the packing station until that meat cut has arrived, and is then used to dispense or apply the appropriate bag or wrap for that meat cut. Again the nth pack provided at that packing station would be synchronised with the nth meat cut directed to the packing station. In a yet more sophisticated arrangement individual meat cuts may be tracked through the apparatus along the conveyors so that the system can detect if any individual meat cut is removed from the product stream for any reason, to again avoid mis-indexing of the meat cuts and packs this may be achieved by detecting and tracking the movement of each meat cut from one conveyor to the next. Again various arrangements are possible.

The individual bag dispensers or packing stations may include associated printing means such as a print head arranged to print information on individual bags or wraps for individual meat cuts as the packs are dispensed or applied, such as information as to the meat cut weight, cut type, processing or other date, carcass identification information ie identifying the supplier to the meat processing plant of the animal from which the meat cut has been obtained, and/or the individual carcass, or other information relating to the meat cut(s). In one arrangement, each meat cut may at an earlier processing stage be tagged with a physical tag such as a stick-in tag carrying carcass identification information such as a bar code, and rf tag, or other machine readable code identifying the supplier of the meat cut. This code may be read by a reader before or after the machine vision stage or as the meat cut approaches a packing station to provide the carcass identification information or other information relating to the meat cut to the print system.

FIG. 3 shows a preferred form of apparatus of the invention generally similar to that of FIGS. 1 and 2, and in FIG. 3 like reference numbers as in FIGS. 1 and 2 indicate like components. In the apparatus of FIG. 3 diversion stage 9 directs individual meat cuts to a manual packing station generally indicated at 15 or an automated bagging or wrapping and sealing station generally indicated at 16 which is arranged to automatically place meat cuts into bags or wrap or seal or otherwise pack the meat cuts, and then send the meat cuts down conveyor 17. Alternatively the diversion conveyor may direct to outlet 18 meat cuts outside of a size range able to be handled at packing stations 15 or 16, or which are rejected or otherwise considered non-standard for any reason. Such meat cuts may be delivered from outlet 18 to another conveyor or any further processing stage for further handling. Packed meat cuts exiting the manual and automated packing stages 15 and 16 on conveyors 17 and 19 are merged at conveyor 20 and delivered to any further processing stage such as vacuuming, shrinking, boxing, chilling, or similar.

Figure 4C:
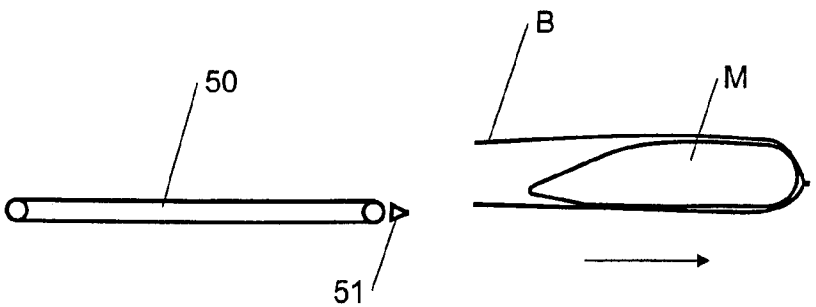
Figure 4B:
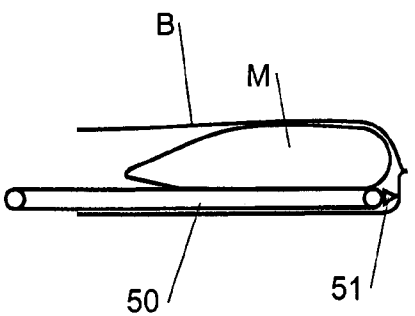
Figure 4A:
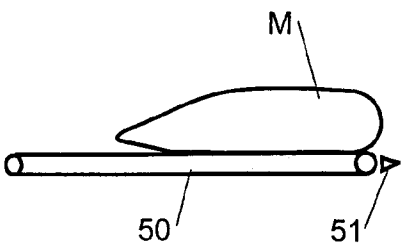

The preferred form apparatus of the invention described above may also include as indicated at 50 in FIGS. 1 and 3 a preferred form of bagging apparatus to assist operators in manually placing bags over the meat cuts when packing the meat cuts in bags, or to assist an automatic bagging machine in placing bags over the meat cuts or the meat cuts into the bags. FIGS. 4A to 4C schematically show the operation of the preferred form bagging apparatus. The apparatus comprises a short conveyor or conveyor table 50 or series of two or three adjacent parallel conveyors onto which meat cuts arrive at the packing station 5 as shown in FIG. 4A. Typically during ejection of the previously packed meat cut by the conveyor(s) 50 the same movement of the conveyor brings forward the next meat cut. An operator brings a bag B dispensed to the operator at the packing station as described above, over the meat cut M on the stationary conveyor 50 as shown in FIG. 4B. In one form placement of the bag B on the meat cut M contacts bar 51 extending along the forward end of the conveyor table which in turn activates conveyor 50 to eject the now bagged product from the packing station as illustrated in FIG. 4C. When pressure is applied to the bar 51 by the bottom of a bag brought home over the meat cut M as shown in FIG. 4B a microswitch or proximity sensor may be triggered. Any other arrangement which will activate the conveyors 50 to eject the bagged meat cut from the packing station once the bag is placed over the meat cut may be utilised, such as a light beam arranged to be broken when the bag is home on the product or any other form of electronic or non-physical or mechanical sensor.

Figure 5:
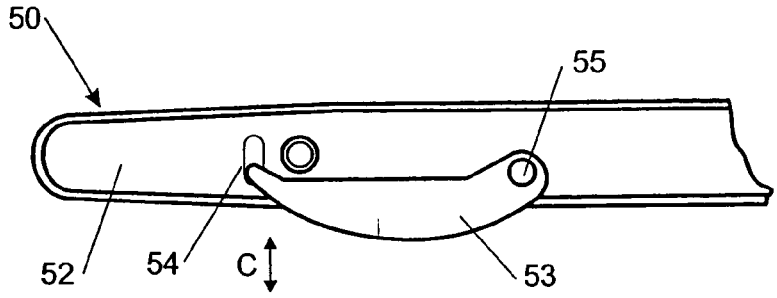
FIG. 5 is a side view of a preferred form bagging apparatus.
Figure 6:
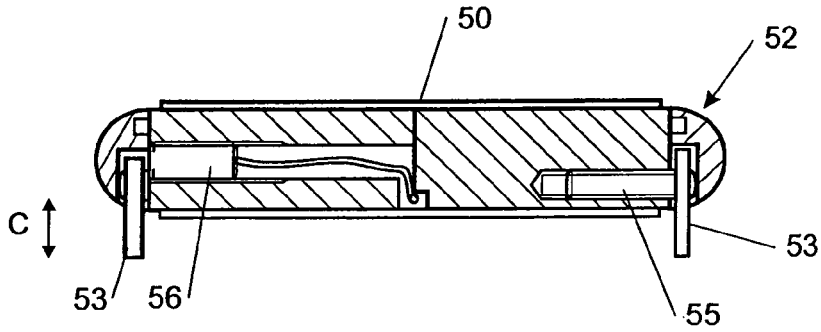
FIG. 6 is a transverse cross-section view of the preferred form bagging apparatus of FIG. 5.
Figure 7:
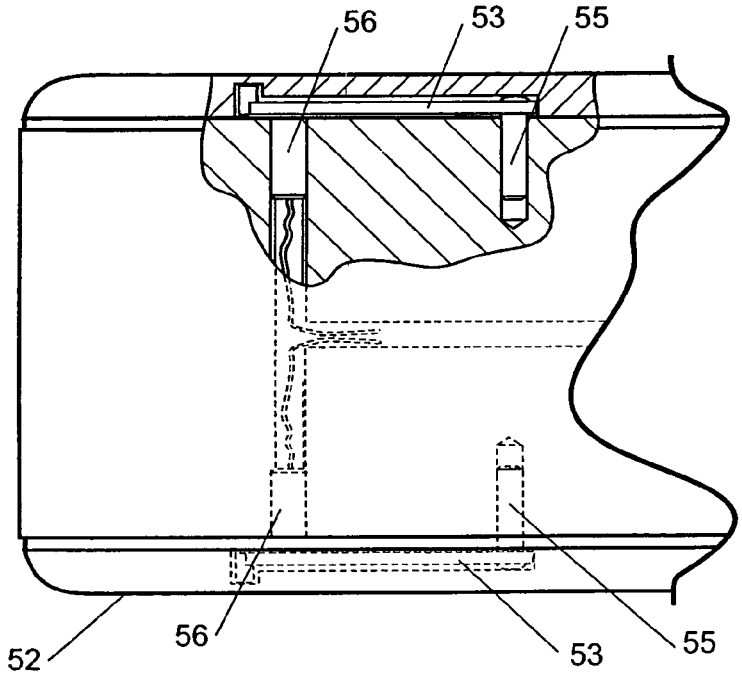
FIG. 7 is a plan part-sectional view of the end of the preferred form bagging apparatus.

FIGS. 5 to 7 show in more detail one preferred form of bagging apparatus. Conveyor 50 moves around table 52. When a meat cut arrives at the packing station it moves on to the then stationary conveyor 50. A mechanical trigger system consists of two independent trigger bars 53 on either side of the table 52 shaped as shown, and which are guided at their forward ends in slots 54 in the forward end of the table 52. The trigger bar is mounted for pivotal movement in the direction of arrow C in FIGS. 5 and 6 about axle members 55 which are journalled in the table 52 as shown. When a bag is brought over the forward end of the table 52 and conveyor 50, (to the position shown in FIG. 4B), and the bag is pulled upwardly slightly, upward pressure of the underside of the bag will deflect upwardly one or other of the trigger bars 53 which closes electrical switches or triggers proximity sensors 56 which in turn activates the conveyor 50 to eject the bagged product (and bring forward the next meat cut). An advantage of this arrangement is that the operator has control of the timing of the ejection of the bag product from the bagging conveyor since ejection is activated by the operator pulling upwardly slightly on the bag as the operator brings the bag fully home over the meat cut on the conveyor 50.

In one preferred configuration the convey 50 and table 52 may consist of two or three adjacent parallel conveyors—a larger bag for a large meat cut is then slid over all three conveyor "fingers", a mid-size bag may be slid over only two conveyor "fingers", with at one point the bag sliding between the middle finger and an outer finger, and a smaller bag for a smaller meat cut may be slid over only a single conveyor.

The foregoing describes the invention including preferred forms thereof. Alterations and modifications as will be obvious to those skilled in the art are intended to be incorporated in the scope hereof as defined in the accompanying claims.

What is claimed is:

1. An apparatus for use in packing meat cuts, comprising:

a) a meat cut information acquisition stage arranged to acquire information relating to one or more characteristics of the individual meat cuts passing the meat cut information acquisition stage wherein the meat cut information acquisition stage comprises a machine vision system adapted to provide at least one beam which scans the meat cuts or through which the meat cuts pass to acquire information relating to the individual meat cuts;

b) a plurality of meat cut packing stations, at least one of which is arranged to provide a pack (i) different in size than a pack provided by another of the plurality of meat cut packing stations, or (ii) different in type than a pack provided by another of the plurality of meat cut packing stations; and c) a diversion stage between the meat cut information acquisition stage and the plurality of meat cut packing stations, the diversion stage arranged to direct individual meat cuts to one or other of the plurality of packing stations based on information relating to the individual meat cuts from the meat cut acquisition stage.

2. The apparatus according to claim 1 wherein at least one of the plurality of meat cut packing stations is arranged to receive acquired information relating to individual meat cuts as they leave the meat cut information acquisition stage or move between or arrive at the at least one meat cut packing station, or instructions associated with individual meat cuts from a control system, and to dispense to an operator or automatedly apply to the meat cuts a pack matched to each individual meat cut arriving at the at least one meat cut packing station.

3. The apparatus according to claim 1 wherein at least one of the plurality of meat cut packing stations is arranged to dispense or apply larger packs, and at least one of the plurality of meat cut packing stations is arranged to dispense or apply smaller packs, and a control system and the diversion stage are arranged to divert larger meat cuts to the at least one of the plurality of meat cut packing stations arranged to dispense or apply larger packs, and smaller meat cuts to the at least one other of the plurality of packing stations arranged to dispense or apply smaller packs.

4. The apparatus according to claim 1 wherein at least one of the plurality of meat cut packing stations is arranged to dispense or apply packs of a first type at least one of the plurality of meat cut packing stations is arranged to dispense or apply packs of a second type different than the packs of the first type, and a control system and the diversion stage are arranged to divert some meat cuts to the at least one of the plurality of meat cut packing stations arranged to dispense or apply packs of the first type, and to divert other meat cuts to the at least one of the plurality of meat cut packing stations arranged to dispense or apply packs of the second type different than the packs of the first type.

5. The apparatus according to claim 1 wherein at least one of the plurality of meat cut packing stations is arranged to dispense or apply plastic packs of greater width, and at least one of the plurality of meat cut packing stations is arranged to dispense or apply plastic packs of lesser width.

6. The apparatus according to claim 1 wherein at least one of the plurality of meat cut packing stations is arranged to manufacture and dispense or apply plastic packs in different lengths from continuous packing material stock based on information relating to individual meat cuts acquired at the meat cut information acquisition stage.

7. The apparatus according to claim 1 wherein at least one of the plurality of meat cut packing stations is arranged to dispense or apply a number of different sizes or types of pack, and a control system is arranged to cause the at least one meat cut packing station to dispense or apply a single pack matched to each individual meat cut as each meat cut arrives at the at least one meat cut packing station.

8. The apparatus according to claim 1 wherein the acquired information relating to individual meat cuts comprises at least one of dimensional information, volume information, or shape information, and a manual input means enables manual input by an operator to a control system of meat cut type information, meat quality or grading information or other information relating to the meat cuts.

9. The apparatus according to claim 1 wherein at least one of the plurality of meat cut packing stations comprises printing means arranged to print, on packs or pack material dispensed or applied for individual meat cuts, information indicative of at least one of meat cut weight, cut type, date, carcass identification information, or other information relating to the meat cuts.

10. The apparatus according to claim 1 wherein the meat cut information acquisition stage comprises a camera based machine vision system.

11. The apparatus according to claim 1 wherein the diversion stage comprises a conveyor or chute arranged to swing about an axis to deliver individual meat cuts to one of two or more downstream conveyors, or to at least one of the plurality of meat cut packing stations.

12. The apparatus according to claim 11 wherein the diversion conveyor is mounted on a sub-frame for pivoting movement about a generally vertical or horizontal axis and comprises a drive system for driving the pivotal movement of the diversion conveyor when activated by a control system.

13. The apparatus according to claim 1 comprising at least one a queuing conveyor disposed between the diversion stage and at least one of the plurality of meat cut packing stations, which at least one queuing conveyor is arranged to queue individual meat cuts before the at least one meat cut packing station to which the individual meat cuts have been directed by the diversion stage.

14. The apparatus according to claim 1 comprising an in-line weigh station for weighing meat cuts as they pass over the weigh station.

15. The apparatus according to claim 1 comprising automated packing apparatus arranged to automatedly bag individual meat cuts in plastic bags at at least one of the plurality of meat cut packing stations.

16. The apparatus according to claim 1 comprising automated packing apparatus arranged to apply packs to individual meat cuts by automatedly wrapping and sealing individual meat cuts in a packing material at at least one of the plurality of meat cut packing stations.

17. An apparatus for use in packing meat cuts, which comprises:

(a) a machine vision system arranged to scan or view individual meat cuts passing a meat cut information acquisition stage and acquire dimensional, volume, shape, cut type, or meat quality or grading information relating to the individual meat cuts, (b) a plurality of meat cut packing stations, at least one of which is arranged to provide a pack (i) different in size than a pack provided by another of the plurality of meat cut packing stations, or (ii) different in type than a pack provided by another of the plurality of meat cut packing stations, and which at least one packing station is arranged to i) receive acquired information relating to individual meat cuts as the meat cuts leave the meat cut information acquisition stage, or move toward the at least one packing station, or instructions associated with individual meat cuts from a control system, and to ii) dispense to an operator or automatedly apply to the meat cuts a pack matched to each individual meat cut arriving at the at least one packing station, and (c) a diversion stage disposed between the meat cut information acquisition stage and the plurality of meat cut packing stations, under control of a control system associated with, or arranged to receive information from the machine vision system, which diversion stage is arranged to direct individual meat cuts to one of the plurality of meat cut packing stations based on acquired information relating to the individual meat cuts from the meat cut acquisition stage.

* * * * *

UNITED STATES PATENT AND TRADEMARK OFFICE

CERTIFICATE OF CORRECTION

PATENT NO. : 6,996,948 B2
APPLICATION NO. : 10/362433
DATED : February 14, 2006
INVENTOR(S) : Koke et al.

It is certified that error appears in the above-identified patent and that said Letters Patent is hereby corrected as shown below:

Column 8, Line 55, "adapted to provide at least one beam which scans the meat cuts or through which the meat cuts pass to acquire information relating to the individual meat cuts" should be -- arranged to scan or view and adapted to acquire at least one of dimensional information, volume information, shape information, meat cut type information, meat quality or grading information, or other information relating to the individual meat cuts--

Column 10, Line 26, "one a queuing conveyor" should be --one queuing conveyor--

Signed and Sealed this

Nineteenth Day of June, 2007

JON W. DUDAS
*Director of the United States Patent and Trademark Office*